US009810483B2

(12) United States Patent
Bilski et al.

(10) Patent No.: US 9,810,483 B2
(45) Date of Patent: Nov. 7, 2017

(54) VARIABLE-CONDUCTANCE HEAT TRANSFER DEVICE

(75) Inventors: Walter John Bilski, Mohnton, PA (US); Jerome E. Toth, Exton, PA (US); John G. Thayer, Lancaster, PA (US)

(73) Assignee: Thermal Corp., Wilmington, DE (US)

( * ) Notice: Subject to any disclaimer, the term of this patent is extended or adjusted under 35 U.S.C. 154(b) by 636 days.

(21) Appl. No.: 13/473,755

(22) Filed: May 17, 2012

(65) Prior Publication Data

US 2013/0299136 A1 Nov. 14, 2013

Related U.S. Application Data

(60) Provisional application No. 61/645,906, filed on May 11, 2012.

(51) Int. Cl.

| | |
|---|---|
| ***F28F 27/00*** | (2006.01) |
| ***F28D 15/04*** | (2006.01) |
| ***F28F 13/14*** | (2006.01) |
| ***F28D 15/02*** | (2006.01) |

(52) U.S. Cl.
CPC ..... *F28D 15/046* (2013.01); *F28D 15/0275* (2013.01); *F28F 13/14* (2013.01)

(58) Field of Classification Search
CPC ..... F28D 15/06; F28D 15/00; F28D 15/02; F28D 15/0266; F28D 2015/0291
USPC ..... 165/274, 272, 104.21, 104.27, 104.32, 165/104.33
See application file for complete search history.

(56) References Cited

U.S. PATENT DOCUMENTS

| | | | | |
|---|---|---|---|---|
| 3,414,050 | A * | 12/1968 | Anand | 165/274 |
| 3,750,745 | A | 8/1973 | Moore, Jr. | |
| 3,776,304 | A * | 12/1973 | Auerbach | 165/96 |
| 3,965,970 | A | 6/1976 | Chisholm | |
| 4,162,394 | A | 7/1979 | Faccini | |
| 4,170,262 | A | 10/1979 | Marcus et al. | |
| 4,437,510 | A * | 3/1984 | Martorana | 165/274 |
| 4,785,875 | A | 11/1988 | Meijer et al. | |
| 4,883,116 | A | 11/1989 | Seidenberg et al. | |
| 4,921,041 | A * | 5/1990 | Akachi | 165/104.29 |
| 5,044,426 | A | 9/1991 | Kneidel | |
| 5,566,751 | A * | 10/1996 | Anderson et al. | 165/104.27 |
| 5,647,429 | A * | 7/1997 | Oktay et al. | 165/104.26 |
| 5,667,003 | A | 9/1997 | Mahdjuri-Sabet | |
| 6,167,955 | B1 * | 1/2001 | Van Brocklin et al. | 165/272 |
| 6,571,863 | B1 * | 6/2003 | Liu | 165/104.21 |
| 7,272,941 | B2 | 9/2007 | TeGrotenhuis et al. | |
| 2007/0095506 | A1 * | 5/2007 | Hou et al. | 165/104.26 |

(Continued)

OTHER PUBLICATIONS

Koplow, "A Fundamentally New Approach to Air-cooled Heat Exchangers," Sandia National Laboratories, Jan. 2010, 48 pages.

*Primary Examiner* — Travis Ruby
(74) *Attorney, Agent, or Firm* — Michael Best & Friedrich LLP

(57) ABSTRACT

A heat transfer device is provided for conducting heat from a heat source. The heat transfer device generally includes an evaporator for generating a vapor, a condenser in fluid communication with the evaporator, and a vapor flow restrictor interposed between the evaporator and the condenser, wherein the vapor flow restrictor can increase vapor pressure in at least a portion of the evaporator relative to vapor pressure in the condenser.

56 Claims, 9 Drawing Sheets

(56) References Cited

U.S. PATENT DOCUMENTS

2007/0204975 A1* 9/2007 Liu et al. ..... 165/104.26
2007/0235165 A1* 10/2007 Liu et al. ..... 165/104.26

* cited by examiner

VARIABLE-CONDUCTANCE HEAT TRANSFER DEVICE

CROSS-REFERENCE TO RELATED APPLICATIONS

This application claims priority of U.S. Provisional Patent Application No. 61/645,906, filed May 11, 2012, the content of which in incorporated herein by reference in its entirety.

BACKGROUND

A heat pipe can conduct heat from a heat source such as from an electronic device through vapor heat transfer. Typically, the heat pipe includes a working fluid, an evaporator section, and a condenser section. The working fluid is vaporized at the evaporator section. The vapor is received at the condenser section, whereupon the vapor is condensed to form a liquid working fluid. Capillary action returns the condensed working fluid to the evaporator section, thereby completing a cycle.

In a variable-conductance heat pipe (VCHP), the conductance of the heat pipe will vary depending on the operating temperature. This is typically achieved through a non-condensable gas, e.g., a noble gas such as helium, argon, nitrogen or the like, in an interior of the heat pipe. The non-condensable gas resides in passages adjacent to the condenser section. As the heat load from a heat source increases or as the evaporator temperature increases, the vapor pressure of the working fluid increases, forcing the non-condensable gas to compress and expose more of the condenser area. The dense vapor of the working fluid can then reach the exposed condenser surface for vapor condensation. On the other hand, when the evaporator is at a low temperature, the volume of the non-condensable gas increases, thereby increasing the blocked part of the condenser. The working fluid has a low vapor pressure allowing the component to warm up before the heat is removed. Due to the low vapor pressure, a relatively high volumetric flow rate would be needed to achieve a given amount of heat transfer. This high vapor flow rate can in turn facilitate maintaining the heat source at a relatively constant temperature despite a variation in the heat pipe's operating temperature.

SUMMARY

It can be cumbersome to put an exact amount of non-condensable gas into a conventional VCHP. Moreover, adding passages for the non-condensable gas adjacent the condenser section can be difficult, costly, and hard to reliably replicate when making multiple units. Thus, there has developed a need for a heat pipe that can vary its conductance depending on the heat pipe's operating temperature, without solely relying on the non-condensable gas.

In some embodiments, a heat transfer device is provided for conducting heat from a heat source. The heat transfer device generally includes an evaporator for generating a vapor, a condenser in fluid communication with the evaporator, and a vapor flow restrictor interposed between the evaporator and the condenser, wherein the vapor flow restrictor can increase vapor pressure in at least a portion of the evaporator relative to vapor pressure in the condenser.

Also, in some embodiments, a heat transfer device is provided for conducting heat from a heat source, and generally includes an evaporator for generating a vapor, a condenser in fluid communication with the evaporator, and a vapor flow restrictor is interposed between the evaporator and the condenser, wherein the vapor flow restrictor is positioned adjacent the evaporator and includes a baffle with an orifice therethrough.

In some embodiments, a heat transfer device is provided for conducting heat from a heat source, and generally includes an evaporator, a condenser in fluid communication with the evaporator, and a vapor flow restrictor interposed between the evaporator and the condenser and adjacent the evaporator, wherein at least one of the evaporator and condenser comprises a wall having a wick disposed on at least a portion thereof, wherein a vapor flows between the evaporator and the condenser, and wherein the wick has a working fluid in contact therewith in a liquid form. The vapor flow restrictor comprises a baffle having an opening therethrough.

Also, in some embodiments, a heat transfer device is provided for conducting heat from a heat source, wherein the heat transfer device generally includes an evaporator for generating a vapor, and a condenser in fluid communication with the evaporator, wherein a vapor flow restrictor is interposed between the evaporator and the condenser, and is positioned adjacent the evaporator. The vapor is substantially free of non-condensable gas.

In some embodiments, a method of conducting heat from a heat source generally includes providing a heat transfer device that includes an evaporator for generating a vapor, a condenser in fluid communication with the evaporator, and a vapor flow restrictor interposed between the evaporator and the condenser, wherein the vapor flow restrictor is positioned adjacent the evaporator, and wherein vapor pressure can be increased in at least a portion of the evaporator relative to vapor pressure in the condenser.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Figure 1:
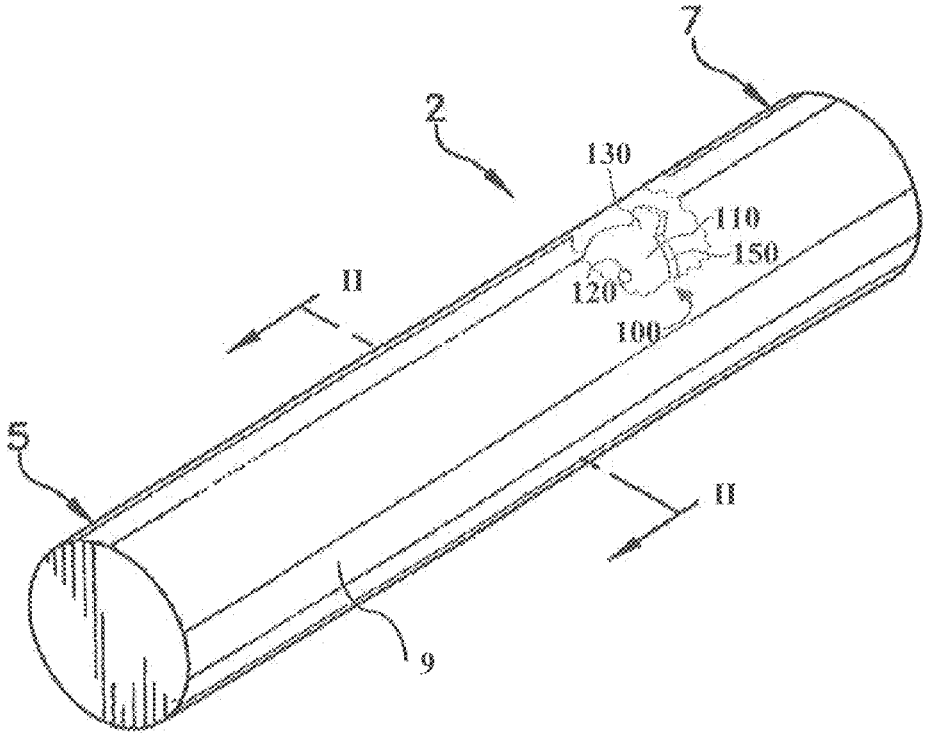
FIG. 1 is a perspective view of a heat pipe.

FIG. 1 is a perspective view of a heat transfer device such as a heat pipe 2 for conducting heat from a heat source. The heat pipe 2 includes a working fluid (not shown), an evaporator 5, and a condenser 7 in fluid communication with the evaporator 5. The heat source is positioned in thermal contact with the evaporator 5, making either direct contact or indirect thermal contact with the evaporator 5. The working fluid is vaporized at the evaporator 5. The vapor flows from the evaporator 5 and is received at the condenser 7, whereupon the vapor is condensed to form a liquid working fluid. Capillary action or gravity returns the condensed working fluid to the evaporator 5, thereby completing a cycle. The vapor may be substantially free of non-condensable gas. However, the vapor may include a portion of non-condensable gas so as to suitably modulate heat transmission properties of the heat pipe 2. In the illustrated heat pipe 2, the evaporator 5 and the condenser 7 are both enclosed by a common wall 9. It is to be appreciated, however, that the evaporator 5 and the condenser 7 may instead be individually enclosed by separate walls while still establishing fluid communication between the evaporator 5 and condenser 7. The wall 9 may be constructed from any suitable material, such as a metallic (e.g., aluminum, copper, magnesium, or stainless steel) material or alloy thereof.

As noted above, a working fluid resides within the heat transfer device 2 to facilitate heat transfer. Any number of fluids can be suitable as a working fluid so long as they have a liquid phase and a vapor phase. Suitable working fluids include, but are not limited to, water, ammonia, Freon, acetone, ethane, ethanol, heptane, methanol, potassium, sodium, hydrocarbons, fluorocarbons, methyl chloride, liquid metals such as cesium, lead, lithium, mercury, rubidium, and silver, cryogenic fluids such as helium and nitrogen, and other fabricated working fluids. The particular working fluid can be chosen depending on the operating temperature requirements, the material of the heat pipe wall 9, or upon preferences for the particular heat transfer device 2.

Figure 2:
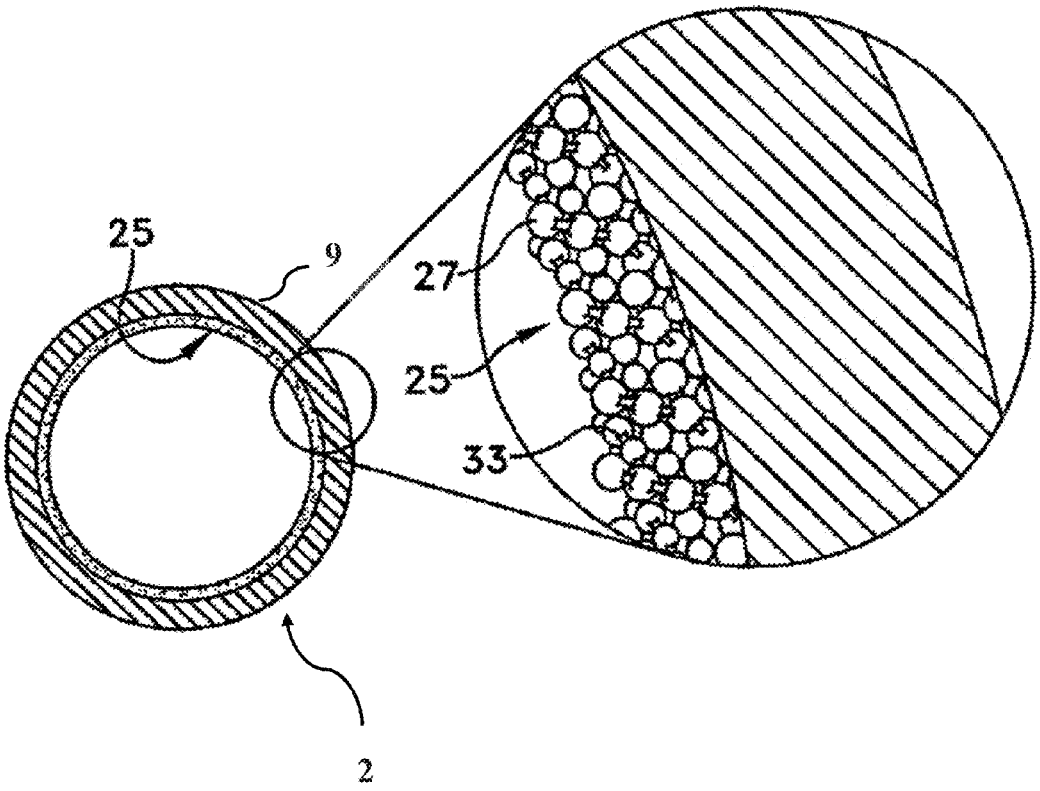
FIG. 2 is a cross-sectional view of the heat pipe of FIG. 1 taken along line II-II of FIG. 1.

Referring also to FIG. 2, the illustrated heat pipe 2 includes a wick 25 disposed on at least a portion of the wall 9 of the heat pipe 2. The illustrated wick 25 comprises a plurality of particles 27 that are combined with a brazing compound 33. Brazing refers to the joining of materials through the use of heat and a filler such as the brazing compound 33. The brazing compound 33 can have a melting point that is above 450° C.-1000° C. but typically below the melting point of the particles 27 that are being joined to form the brazed wick 25. The particles 27 may be made of any material having a high thermal conductivity and suitable for fabrication into a brazed porous structure, e.g., carbon, tungsten, copper, aluminum, magnesium, nickel, gold, silver, aluminum oxide, beryllium oxide, and the like. The wick 25 has the working fluid in contact therewith in a liquid form. Although the illustrated wick 25 is formed by brazing a plurality of particles, it is to be appreciated that the wick 25 may be formed by any materials and methods so as to suitably provide a capillary action that returns the condensed working fluid to the evaporator 5.

Figure 3:
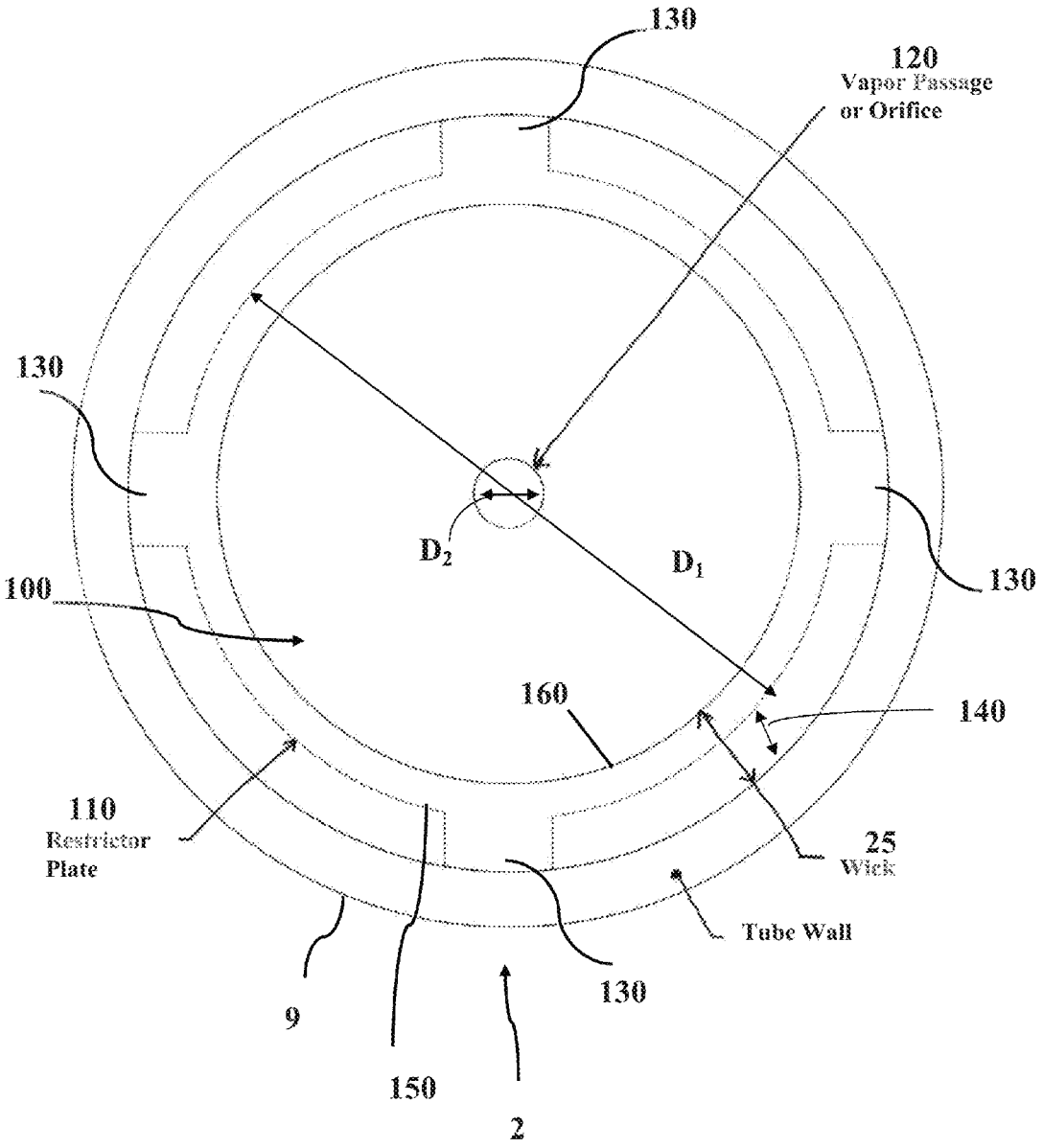
FIGS. 3, 7, and 8 each presents a cross-sectional view of a heat pipe, illustrating a vapor flow restrictor according to an embodiment of the invention.
Figure 3A:
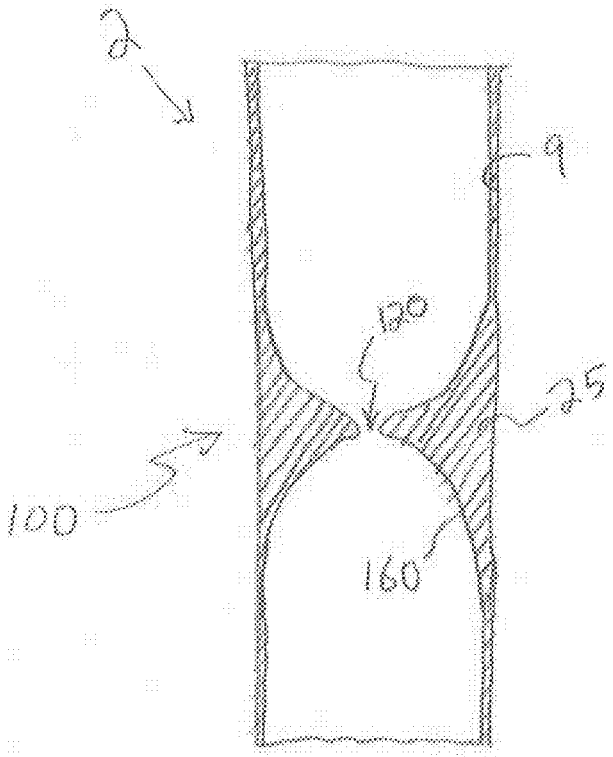
Figure 3B:
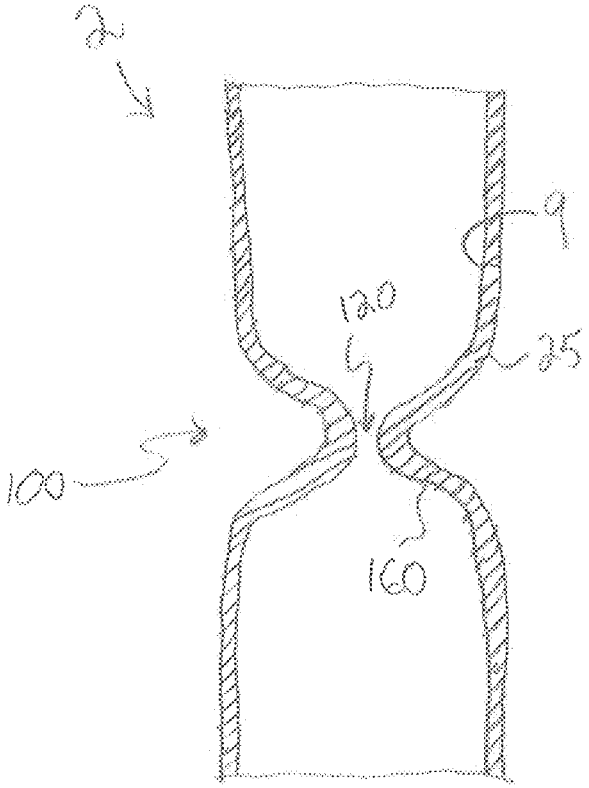

FIG. 3 is a cross-sectional view of the heat pipe 2, illustrating a vapor flow restrictor 100. The vapor flow restrictor 100 is interposed between the evaporator 5 and the condenser 7. In general, the flow restrictor is located outside the evaporator 5, for example adjacent the evaporator 5. In some embodiments, the vapor flow restrictor 100 is positioned at no more than half way from the evaporator 5 to the condenser 7. In other embodiments, the flow restrictor may be positioned at no more than one-third of the way from the evaporator 5 to the condenser 7. In the embodiment shown in FIG. 3, the vapor flow restrictor 100 includes a baffle 110 with an orifice or opening 120 therethrough. In some embodiments, the baffle 110 is a plate, although other structures performing the same function as the baffle 110 disclosed herein can be used instead. In general, the primary route for vapor movement is through the orifice or opening 120 in the baffle 110, rather than through the wick material, while fluid flow is permitted adjacent the baffle 110 (i.e., past the baffle 110 at one or more locations about the periphery of the baffle 110). In the illustrated embodiment, the orifice 120 is located in the baffle 110 such that the orifice 120 is located approximately at a center of the heat transfer device 2. In some embodiments in particular, the orifice 120 is formed in a fine-pore wick material which permits flow of condensed working fluid to pass therethrough. However, the surface tension of the liquid in the fine-pore wick material deters vapor from penetrating the fine pore structure, thus preventing the vapor from traveling through the wick and instead requiring the vapor to travel through the orifice 120.

The illustrated baffle 110 has a baffle diameter $D_1$. The orifice 120 defines a vapor passageway, and has an orifice diameter $D_2$. In some embodiments, the orifice 120 diameter $D_2$ varies from 0.5% to 15% of the baffle 110 diameter $D_1$, although the orifice 120 diameter $D_2$ can be even less than 0.5% of the baffle 110 diameter $D_1$. Accordingly, in embodiments employing a flow restrictor baffle 110, the conductance of the heat pipe 2 can be varied depending at least in part upon the temperature without solely relying on non-condensable gas, as will be explained further below. Moreover, in some embodiments, the orifice diameter $D_2$ may be required to have a particular tolerance dependent on the application. For example, one application may require a tolerance of approximately ±0.01 mm, while another application may allow a tolerance of approximately ±0.1 mm.

In some embodiments, the baffle 110 may have a shape other than circular (e.g. oval, square, rectangular, or other regular or irregular shapes) in which cases the cross-sectional dimensions may be expressed in terms other than diameter, for example the lengths of major and minor axes or the cross-sectional area of the baffle 110. Similarly, the orifice 120 may have a shape other than circular (e.g. oval, square, rectangle, or other regular or irregular shape) in which cases the cross-sectional dimensions may be expressed in terms other than diameter, for example the lengths of major and minor axes or the cross-sectional area of the orifice 120. In still other embodiments, the orifice 120 may include more than one opening, i.e. the orifice 120 may include two or more openings in the baffle 110, e.g. if a screen is used as part of the vapor flow restrictor 100 (see below). In general, it is the total area of the opening(s) of the orifice(s) combined that has the greatest impact on performance, whereas loss coefficients based on different sizes and shapes of the orifice(s) have a secondary effect. The size of the orifice 120 generally depends on the power that it will transmit and the desired operating temperature. The dimensions of the heat transfer device/heat pipe 2 will depend on these factors as well as other factors including, without limitation, the length of the heat transfer device/heat pipe 2, the properties of the wicking material that is used, and the operating orientation of the device.

At high ambient temperatures, vapor pressure of the working fluid inside the heat pipe 2 increases. The dense vapor of the working fluid passes through the orifice 120 to reach the condenser 7 for vapor condensation. The high vapor pressure of the working fluid means that a given amount of heat transfer would require a relatively low vapor flow rate. Because the vapor flow rate is low, the orifice 120 does not substantially restrict the flow of the vapor. The heat pipe 2 thus operates at full capacity and can efficiently cool a heat source. As such, the temperature differential between the evaporator 5 and condenser 7 of the heat pipe 2 is relatively low at high operating temperatures.

At low ambient temperatures, vapor pressure of the working fluid decreases. This means that a relatively high vapor flow rate would generally be required for a given amount of heat transfer. The orifice 120 in this case restricts or chokes vapor flow. This has the effect of operating the heat pipe 2 at a reduced capacity. The vapor flow restrictor 100 increases vapor pressure in at least a portion of the evaporator 5 relative to vapor pressure in the condenser 7, thereby increasing the pressure differential. This has the effect of also increasing the temperature differential between the evaporator 5 and the condenser 7 compared to what the temperature differential would be absent the vapor flow restrictor 100. In sum, the temperature differential is low at high ambient temperatures, and high at low ambient temperatures. As a result, the heat source adjacent the evaporator 5 can be maintained at a relatively constant temperature despite a variation in the temperature of the condenser 7 in the heat pipe 2.

The variable conductance of the heat pipe 2 can be beneficial where the temperature of the condenser 7 varies due to environmental conditions. For example, the condenser 7 may be located outdoors. Moreover, the heat pipe 2 that includes the condenser 7 may be sealed during summertime when the humidity is high. When that heat pipe 2 is operating in winter and the condenser 7 is exposed to an ambient temperature of about 4° C., the humidity captured in the enclosure surrounding the device being cooled may condense on an external surface of the heat pipe 2. The condensation could be desirably reduced if the external surface of the heat pipe 2 is maintained at a higher temperature. The vapor flow restrictor 100 can facilitate maintaining the heat pipe 2 at a higher temperature when the ambient temperature is low. As described above, this is achieved by running the heat pipe 2 at a reduced capacity when the ambient temperature is low.

Although FIG. 3 illustrates the orifice 120 diameter $D_2$ as being 0.5% to 15% of the baffle 110 diameter $D_1$, in other embodiments, the orifice 120 diameter $D_2$ may be any percentage of the baffle diameter $D_1$ that is suitable to variably restrict or choke the vapor flow. Also, in some embodiments, the orifice 120 may be located off-center relative to the heat transfer device 2. In still other embodiments, the vapor flow restrictor can comprise a screen. Also, as discussed above, the orifice 120 may have a shape other than circular in which case its dimensions may be expressed in other ways besides diameter, such as area or sizes of major and minor axes.

As noted previously, the vapor flow restrictor 100 is arranged so as to permit fluid to flow past it. In the illustrated embodiment, the vapor flow restrictor 100 includes a plurality of tabs 130. Although FIG. 3 illustrates the vapor flow restrictor 100 including four tabs 130, other embodiments may include a different number of tabs 130. The tabs 130 extend from the baffle 110 to the wall 9 for fixedly connecting the baffle 110 to the wall 9. As such, at least a portion of the baffle 110 is fixedly connected to the wall 9. In other embodiments, however, the baffle 110 may be fixedly connected to the wall 9 by other suitable mechanisms. The tabs 130 comprise at least one gap 140 between the baffle 110 and the wall 9. In operation, vapor is condensed at the condenser 7 to form a working fluid, and the working fluid is returned to the evaporator 5 through the gap 140, such as through a wick 25 that at least partially or completely covers and/or occupies the gap 140. Thus, the vapor flow restrictor 100 permits the working fluid to flow between the condenser 7 and the evaporator 5, while permitting vapor to flow through the orifice 120. Alternatively, the tabs 130 may locate the baffle 110 by being rigidly fixed in the wick 25 without contacting the wall 9.

As described above, the heat pipe 2 comprises a wick 25 disposed on at least a portion of the wall 9. The working fluid flows between the evaporator 5 and the condenser 7 via the wick 25. In some embodiments, both the evaporator 5 and the condenser 7 have the wick 25 disposed therein. The baffle 110 of the vapor flow restrictor 100 has a perimeter 150, which in some embodiments is in contact with the wick 25.

Figure 7:
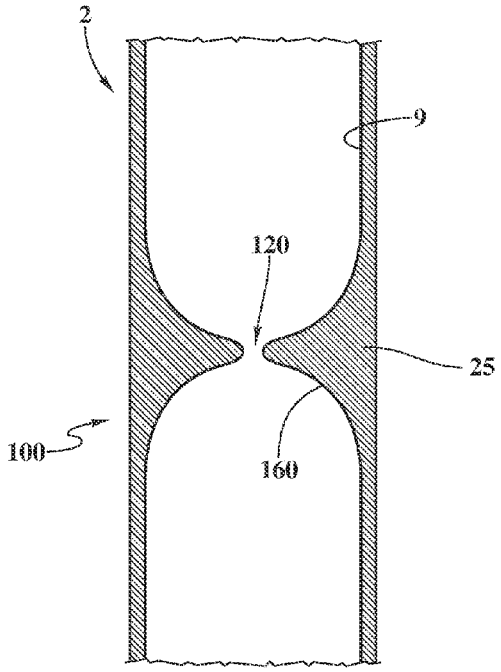
Figure 8:
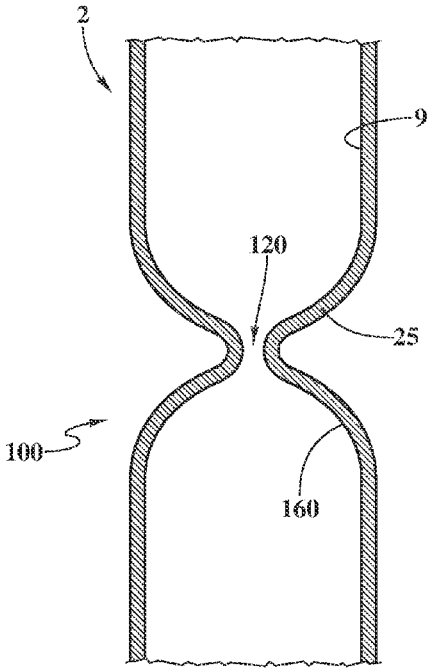

In some embodiments, the vapor flow restrictor 100 comprises at least a portion of the wick 25. The wick 25 can comprise an inner surface 160 spaced apart from the wall 9, wherein at least a portion of the inner surface 160 tapers in a direction along the wall 9. In particular, the wick 25 can be generally hourglass-shaped, i.e. includes a constriction in at least one location, where the orifice is associated with the constriction, with opposite end portions that are wider than the constriction. The hourglass shape of the wick 25 can be achieved by having the thickness of the wick 25 vary in a direction along a cylindrical wall 9 (FIG. 7). Alternatively, the wall 9 of the heat pipe 2 can be shaped to at least partially define the vapor flow restrictor, such as by having an hour-glass shape with a constant-thickness wick 25 or a varying-thickness wick on an inside surface thereof (FIG. 8). Such heat pipe shapes can define an integral vapor flow restrictor (e.g., at the neck of the hourglass shape) having any of the features described above, or can be used in conjunction with a separate flow restrictor (e.g., also at the neck of the hourglass shape) as described and illustrated herein.

Figure 4:
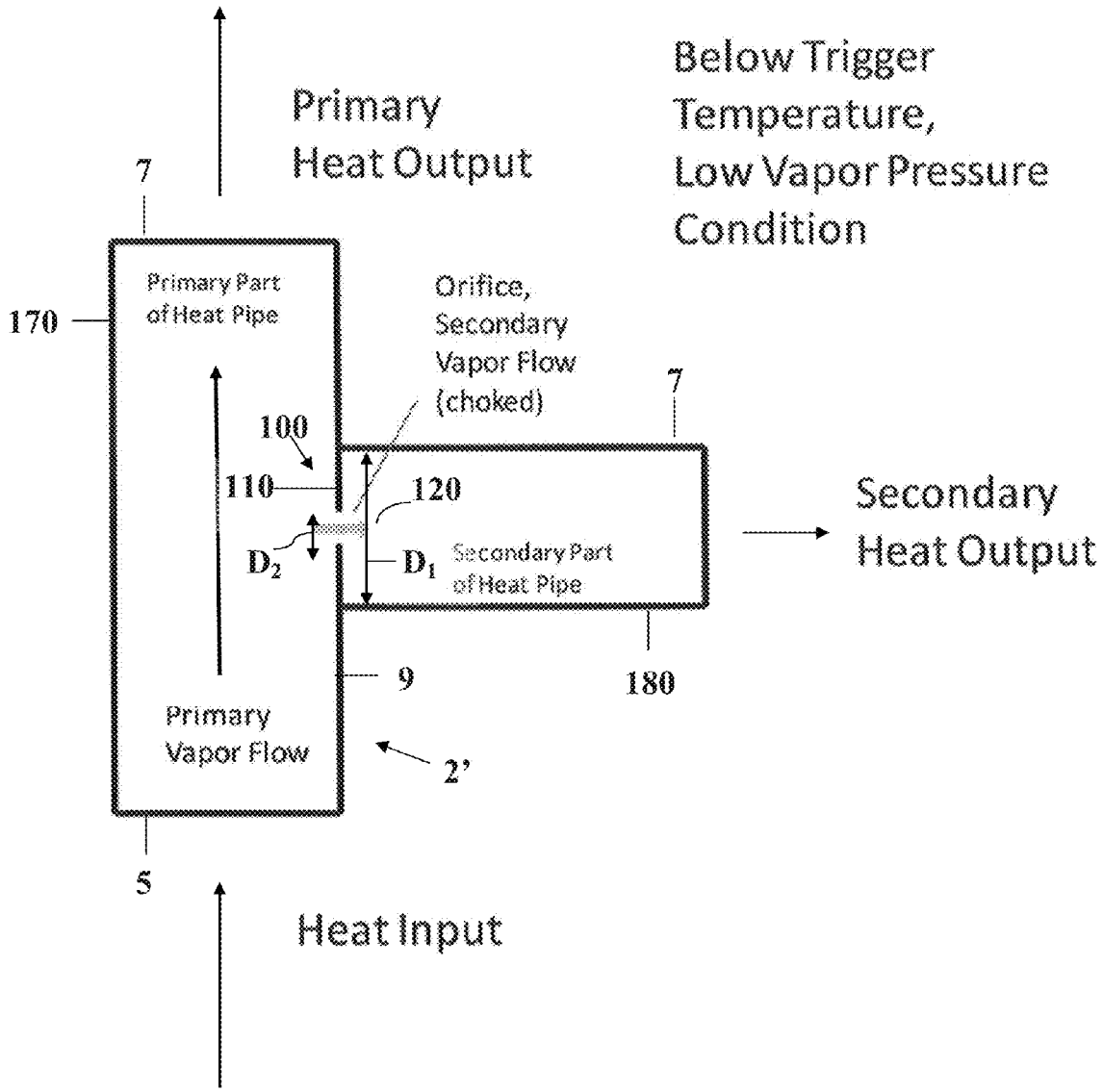
FIG. 4 is a schematic illustration of a heat pipe according to another embodiment of the invention, illustrating a vapor flow restrictor restricting the vapor flow.
Figure 5:
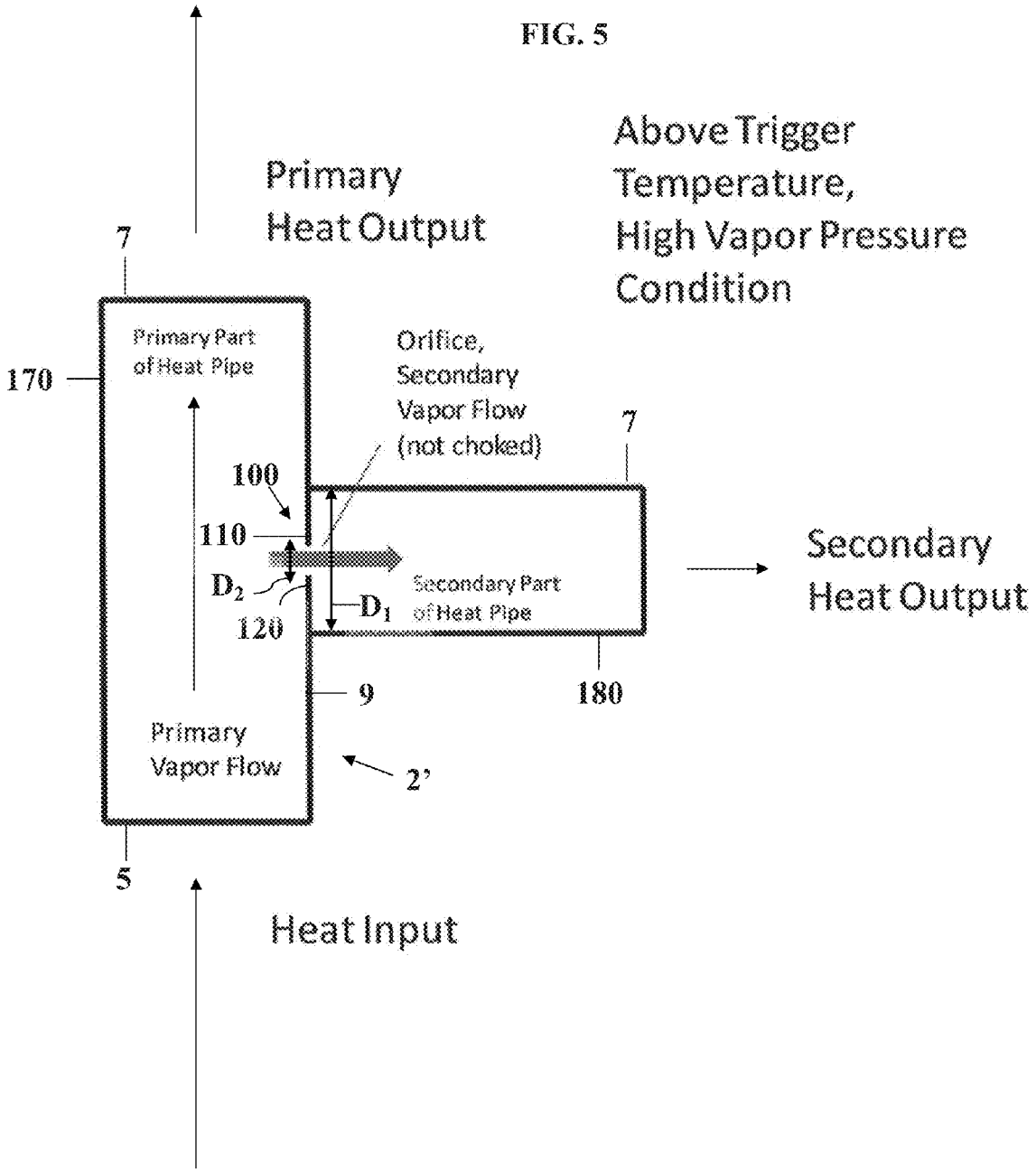
FIG. 5 is a schematic illustration similar to FIG. 4, but illustrating the vapor flow restrictor not restricting the vapor flow.

FIGS. 4-5 illustrate a heat transfer device according to another embodiment of the invention. This embodiment employs much of the same structure and has many of the same properties as the embodiments of the heat transfer device described above in connection with FIGS. 1-3. Accordingly, the following description focuses primarily upon the structure and features that are different than the embodiments described above in connection with FIGS. 1-3. Reference should be made to the description above in connection with FIGS. 1-3 for additional information regarding the structure and features, and possible alternatives to the structure and features of the heat transfer device illustrated in FIGS. 4-5 and described below. Structure and features of the embodiment shown in FIGS. 4-5 that correspond to structure and features of the embodiment of FIGS. 1-3 are designated hereinafter with like reference numbers.

The heat transfer device in this embodiment is a multipart heat pipe 2' that includes a primary part 170 and a secondary part 180 branching from a primary part 170. The primary and secondary parts 170, 180 can assume any suitable geometric forms, including, but not limited to, a cylindrical, a conical, a pyramidal, an ellipsoidal, a regular polyhedral, and an irregular polyhedral shape, derivatives thereof, and combinations thereof. Moreover the primary and secondary parts 170, 180 can have any relative sizes. For example, in some embodiments, the secondary part 180 is substantially the same size as the primary part 170. In other embodiments, however, the secondary part 180 can be sized smaller or larger relative to the primary part 170. In the illustrated embodiment, the secondary part 180 extends from the primary part 170 at a perpendicular angle. In other embodiments, however, the secondary 180 can extend from the primary part 170 at an acute angle, e.g., generally giving the appearance of a y shape. Although FIGS. 4 and 5 illustrate the orifice 120 located at a center portion relative to the secondary part 180, in other embodiments, the orifice 120 may be located off-center relative to the secondary part 180. Moreover, although FIGS. 4 and 5 illustrate a single secondary part 180, in other embodiments, the multipart heat pipe 2' can include a plurality of secondary parts 180.

The secondary part 180 may be, for example, an auxiliary condenser. The multipart heat pipe 2' in this embodiment includes an orifice 120 between the primary part 170 and the secondary part 180 which regulates vapor flow into the secondary part 180. Condensed working fluid is permitted to return from the secondary part 180 to the primary part 170, for example at the junction between the primary part 170 and the secondary part 180. Referring to FIG. 4, the vapor flow restrictor 100 is activated at a low temperature. In this condition, the vapor pressure of the working fluid inside the primary part 170 of the multipart heat pipe 2' is low, which means that a given amount of heat transfer would require a relatively high vapor flow rate. The vapor flow restrictor 100 chokes the vapor flow, thereby increasing the pressure differential across the vapor flow restrictor 100. The vapor flow restrictor 100 thus increases vapor pressure in the evaporator 5 relative to vapor pressure in the condenser 7.

Referring to FIG. 5, at a high temperature, the vapor flow restrictor 100 is deactivated. In this condition, the vapor pressure of the working fluid inside the primary part 170 is high, which means that a given amount of heat transfer would require a relative low vapor flow rate. Because the vapor flow rate is low, the vapor flow restrictor 100 does not substantially restrict the flow of the vapor.

Accordingly, the vapor flow restrictor 100 of the present invention variably restricts the flow of vapor depending upon the temperature of the multipart heat pipe 2'. As described above, this has the effect of maintaining the heat source at a relatively constant temperature despite a variation in the temperature inside the primary part 170 of the multipart heat pipe 2'.

Thus, by placing an orifice between the primary and secondary parts of a multipart heat pipe assembly (or, more generally, between the evaporator and condenser of a heat pipe, loop heat pipe, thermosiphon, or other heat transfer device), the flow of vapor to the secondary part can be restricted when the temperature of the primary part is below a desired trigger point. The orifice is generally sized to achieve choked flow (the sonic limit) in the orifice. This limits the amount of vapor flow through the orifice thus restricting to an acceptably low level the amount of heat that flows to the secondary part when the primary part is below the trigger temperature. When the temperature of the primary part rises above the trigger temperature, the vapor density increase drops the Mach number in the orifice to the point where the flow is no longer choked. Thus, the orifice can sustain a significant flow rate of vapor so that the primary and secondary parts of the heat pipe are nearly isobaric and isothermal. Because the vapor pressure curve as a function of temperature is steep for most heat pipe working fluids, especially close to their freezing temperature, this thermal diode behavior is sharp enough to be useful in practical applications.

Figure 6:
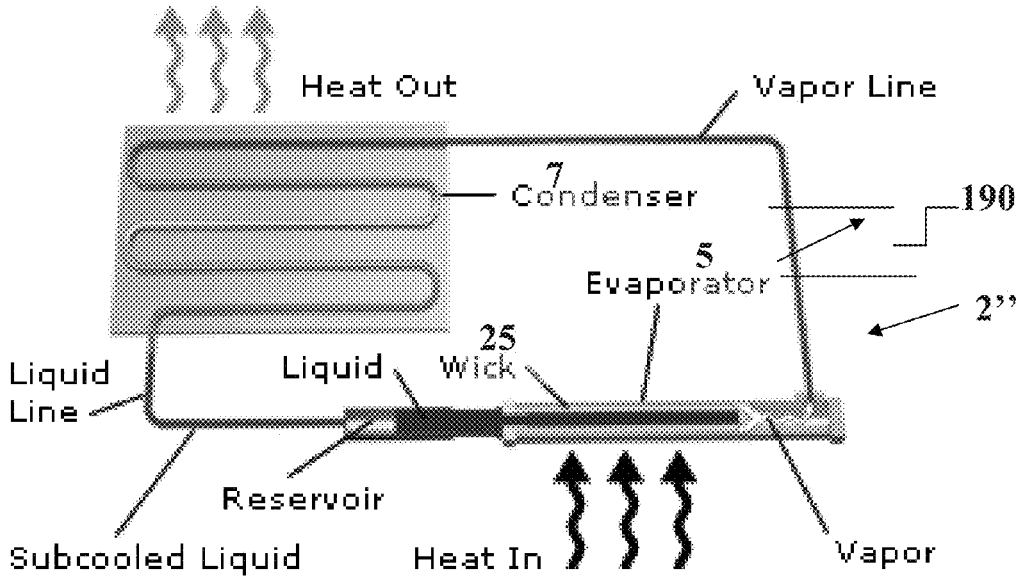
FIG. 6 is a schematic illustration of a heat pipe according to yet another embodiment of the invention.

FIG. 6 illustrates a heat transfer device according to yet another embodiment of the invention. This embodiment employs much of the same structure and has many of the same properties as the embodiments of the heat pipe 2 described above in connection with FIGS. 1-3 and multipart heat pipe 2' described above in connection with FIGS. 4 and 5. Accordingly, the following description focuses primarily upon the structure and features that are different than the embodiments described above in connection with FIGS. 1-5. Reference should be made to the description above in connection with FIGS. 1-5 for additional information regarding the structure and features, and possible alternatives to the structure and features of the heat transfer device illustrated in FIG. 6 and described below. Structure and features of the embodiment shown in FIG. 6 that correspond to structure and features of the embodiments of FIGS. 1-5 are designated hereinafter with like reference numbers.

The heat transfer device in this embodiment may be a loop heat pipe, a loop thermosiphon, or a thermosiphon 2", where the evaporator 5 is connected to the condenser 7 in a closed loop. In this embodiment, the working fluid may return from the condenser 7 to the evaporator 5 via gravity, with or without a wick. In one embodiment, the vapor flow restrictor 100 is placed in the vapor line between the evaporator 5 and condenser 7. Placing the vapor flow restrictor 100 close to the evaporator 5 would be preferred to minimize heat losses from the vapor transport line. The loop heat pipe 2" optionally includes a check valve 190. The check valve can regulate or propel the flow of the working fluid and/or vapor so that the liquid and/or vapor of the working fluid are permitted to move in one direction only and/or toward a predetermined direction. In heat transfer devices such as these which have a continuous circuit, the vapor flow restrictor 100 can be placed at a point between the evaporator and condenser, downstream from the evaporator, for example, in the vapor transport line between the evaporator and condenser.

An illustrative embodiment of the vapor flow restrictor is described in greater detail below.

EXAMPLE

The size of the orifice in the baffle can be calculated based on the sonic velocity of the working fluid vapor inside the heat pipe, where the working fluid in this embodiment is water. The evaporator in this particular example is designed to operate at a temperature between 22° C. and 50° C. A standard heat pipe, which does not vary its conductance in this temperature range, maintains a more or less constant temperature differential between the evaporator and the condenser, where the temperature of the condenser is a function of the cooling fluid, e.g. water or air, that is applied to the condenser. Thus, the temperature of a heat source associated with the evaporator of a standard heat pipe would vary according to the temperature of the condenser, which for certain applications is undesirable. To address this issue, a vapor flow restrictor can be used which permits the heat pipe to transmit the maximum power (i.e. heat removing capability) when the evaporator is at the highest temperature (in this case, 50° C.) and less power when the evaporator is at lower temperatures. The temperature differential between the condenser and the evaporator/heat source is thus variable, thereby maintaining the heat source at a relatively constant temperature (i.e. within the desired operating range of 22° C. to 50° C.). When the heat source (and hence the evaporator) is less than 50° C., less power (heat energy) is transmitted to the condenser due to the vapor flow restrictor and therefore the heat source stays within the operating range of 22° C. to 50° C.

Relevant properties of steam at 50° C. are listed in the following Table 1.

TABLE 1

| | |
|---|---|
| Vapor pressure | 1.7880 $lb/in^2$ |
| Specific volume | 193.18 $ft^3/lb_m$ |
| Enthalpy of vaporization | 1024.1 $BTU/lb_m$ |
| Sonic velocity | 351.2 m/s |

For the heat pipe to transmit a maximum power of 30 watts (equivalent to 102.4 BTU/hr), the area A of the orifice is calculated as follows:

$$A = \left(102.4\frac{\text{BTU}}{\text{hr}}\right)\left(1024.1\frac{\text{BTU}}{\text{lb}_m}\right)^{-1}\left(193.18\frac{\text{ft}^3}{\text{lb}_m}\right)\left(\frac{\text{hr}}{3600\ \text{s}}\right)\left(351.2\frac{\text{m}}{\text{s}}\right)^{-1}\left(\frac{\text{m}}{3.281\ \text{ft}}\right) = 4.656\times10^{-6}\ \text{ft}^2 = 6.705\times10^{-4}\ \text{in}^2$$

If the orifice is round, $A=\pi r^2$, and $$r = \sqrt{\frac{A}{\pi}} = \sqrt{\frac{6.705\times10^{-4}\ \text{in}^2}{3.1415}} = 0.0146\ \text{in.}$$

Therefore, the diameter $D_2$ of the orifice 120 in this case is $D_2=2r=0.0292$ in.

The amount of power transmitted at 22° C. with this orifice can be calculated as follows. Relevant properties of water vapor/steam at 22° C. are listed in the following Table 2.

TABLE 2

| | |
|---|---|
| Vapor pressure | 0.3883 $lb/in^2$ |
| Specific volume | 814.90 $ft^3/lb_m$ |
| Enthalpy of vaporization | 1052.3 $BTU/lb_m$ |
| Sonic velocity | 335.7 m/s |

$$\text{Power} = (4.656\times10^{-6}\ \text{ft}^2)\left(335.7\frac{\text{m}}{\text{s}}\right)\left(\frac{3.281\ \text{ft}}{\text{m}}\right)\left(\frac{3600\ \text{s}}{\text{hr}}\right)\left(814.90\frac{\text{ft}^3}{\text{lb}_m}\right)^{-1}\left(1052.3\frac{\text{BTU}}{\text{lb}_m}\right)\left(\frac{\text{w}\cdot\text{hr}}{3.412\ \text{BTU}}\right) = 7.0\ \text{watts}$$

Thus, a heat transfer device with an orifice diameter $D_2$ of 0.0292 inches, which transmits 30 watts when the evaporator is at 50° C., transmits only 7 watts when the evaporator is at 22° C. The power transmitted by the heat transfer device 2 is therefore variable, and as a result, the heat source can be maintained at a relatively constant temperature.

Although the invention has been described in detail with reference to certain preferred embodiments, variations and modifications exist within the scope and spirit of one or more independent aspects of the invention as described.

What is claimed is:

1. A heat transfer device for conducting heat from a heat source, the heat transfer device having a longitudinal axis and comprising:

an evaporator for generating a vapor, the evaporator defined by at least one wall;

a condenser in fluid communication with the evaporator, the condenser defined by at least one wall, wherein the walls that define the evaporator and the condenser together define an interior space; and a vapor flow restrictor interposed between the evaporator and the condenser, wherein the vapor flow restrictor has opposed planar surfaces each orthogonal to the longitudinal axis of the heat transfer device and an orifice of constant cross section extending between the opposed planar surfaces, wherein the orifice defines a vapor flow path between the evaporator and condenser, wherein the vapor flow path is unobstructed through the orifice at all operating temperatures, wherein the vapor flow restrictor increases vapor pressure in at least a portion of the evaporator relative to vapor pressure in the condenser, wherein the vapor flow restrictor is configured to decrease the vapor flow rate from the evaporator to the condenser as the evaporator temperature decreases, wherein vapor passes from the evaporator toward the condenser through the vapor flow restrictor, and wherein condensed working fluid passes in the interior space from the condenser back toward the evaporator past the vapor flow restrictor.

2. The heat transfer device of claim 1 having a working fluid therein, wherein the vapor flow restrictor permits flow of the working fluid therepast.

3. The heat transfer device of claim 1, wherein at least a portion of an interior surface of one of the walls has wick material attached hereto.

4. The heat transfer device of claim 3, wherein the vapor flow restrictor has a perimeter and wherein the perimeter of the vapor flow restrictor is in contact with at least a portion of the wick material.

5. The heat transfer device of claim 4, wherein flow of working fluid is permitted through the wick material adjacent the vapor flow restrictor.

6. The heat transfer device of claim 5, wherein the vapor flow restrictor is adjacent the evaporator.

7. The heat transfer device of claim 1, wherein the heat transfer device comprises a primary part and a secondary part separated by a separating wall, wherein the orifice is located in the separating wall.

8. The heat transfer device of claim 1, wherein at least a portion of one of the walls has wick material attached thereto, and wherein the wick material comprises a constriction that defines the vapor flow restrictor.

9. The heat transfer device of claim 1, wherein the vapor is substantially free of non-condensable gas.

10. A heat transfer device for conducting heat from a heat source, the heat transfer device comprising:

an evaporator for generating a vapor, the evaporator defined by at least one wall;

a condenser in fluid communication with the evaporator, the condenser defined by at least one wall, wherein the walls that define the evaporator and the condenser together define an interior space; and a vapor flow restrictor interposed between the evaporator and the condenser, wherein the vapor flow restrictor is positioned adjacent the evaporator, wherein the vapor flow restrictor has opposed planar surfaces with an orifice extending between the opposed planar surfaces, the orifice having an inlet and an outlet, the inlet and the outlet being each disposed in one of the opposed planar surfaces, respectively, and having cross-sectional areas of equal size, wherein the orifice defines a vapor flow path between the evaporator and condenser, wherein the vapor flow path is unobstructed through the orifice at all operating temperatures, wherein the vapor flow restrictor is configured to vary the vapor flow rate from the evaporator to the condenser and thereby maintain the temperature of the heat source within a predetermined range, wherein vapor passes from the evaporator toward the condenser through the vapor flow restrictor, and wherein condensed working fluid passes in the interior space from the condenser back toward the evaporator past the vapor flow restrictor.

11. The heat transfer device of claim 10, wherein the vapor flow restrictor is positioned no more than half way from the evaporator to the condenser.

12. The heat transfer device of claim 10, wherein the orifice is located in the vapor flow restrictor such that the orifice is located approximately at a center of the heat transfer device.

13. The heat transfer device of claim 10, wherein the vapor flow restrictor defines a vapor flow restrictor diameter, the orifice defines an orifice diameter, and the orifice diameter is 0.5% to 15% of the vapor flow restrictor diameter.

14. The heat transfer device of claim 10, wherein at least a portion of the vapor flow restrictor is fixedly connected to one of the walls.

15. The heat transfer device of claim 10, wherein the vapor flow restrictor includes a plurality of tabs, the tabs connecting the vapor flow restrictor to an interior surface of one of the walls.

16. The heat transfer device of claim 15, wherein the tabs at least partially define at least one gap between the vapor flow restrictor and the one of the walls, wherein the vapor is condensed at the condenser to form a working fluid, and wherein at least a portion of the working fluid is returned to the evaporator through the gap.

17. The heat transfer device of claim 10, wherein the heat transfer device further comprises a wick disposed on at least a portion of an interior surface of one of the walls.

18. The heat transfer device of claim 17, wherein the vapor flow restrictor at least a portion of the wick.

19. The heat transfer device of claim 18, wherein the wick forms a constriction that defines the orifice in the vapor flow restrictor.

20. The heat transfer device of claim 10, wherein one of the walls has a wick disposed on at least a portion of an interior surface of the wall and the vapor flow restrictor has a perimeter in contact with the wick.

21. The heat transfer device of claim 10, wherein the vapor flow restrictor increases vapor pressure in at least a portion of the evaporator relative to vapor pressure in the condenser.

22. The heat transfer device of claim 10, further comprising a working fluid, wherein the vapor flow restrictor permits the working fluid to flow between the condenser and the evaporator.

23. The heat transfer device of claim 10, wherein the vapor flow restrictor is positioned at no more than one-third of the way from the evaporator to the condenser.

24. The heat transfer device of claim 10, wherein the vapor is substantially free of non-condensable gas.

25. The heat transfer device of claim 10, wherein the evaporator is connected to the condenser in a closed loop.

26. The heat transfer device of claim 10, wherein the temperature of the heat source is maintained at a relatively constant temperature independent of the temperature of the condenser.

27. The heat transfer device of claim 10, wherein the orifice is of constant size through the vapor flow restrictor.

28. A heat transfer device for conducting heat from a heat source, the heat transfer device comprising:

an evaporator defined by at least one wall;

a condenser in fluid communication with the evaporator, the condenser defined by at least one wall, wherein the walls that define the evaporator and the condenser together define an interior space;

a wick disposed on at least a portion of an interior surface of one of the walls, the wick having a working fluid in contact therewith in a liquid form; and a vapor flow restrictor interposed between the evaporator and the condenser, the vapor flow restrictor having an orifice that defines a vapor flow path between the evaporator and condenser, wherein the vapor flow path is unobstructed through the orifice at all operating temperatures, wherein the vapor flow restrictor is positioned adjacent the evaporator, wherein the entire vapor flow restrictor is fixed in position to prevent movement of any portion of the vapor flow restrictor relative to the walls wherein the vapor flow restrictor is configured to vary the vapor flow rate from the evaporator to the condenser and thereby decrease the amount of power transmitted from the evaporator to the condenser as the temperature of the evaporator decreases, wherein vapor passes from the evaporator toward the condenser through the vapor flow restrictor, and wherein condensed working fluid passes in the interior space from the condenser back toward the evaporator past the vapor flow restrictor.

29. The heat transfer device of claim 28, wherein the vapor flow restrictor is positioned at no more than half way from the evaporator to the condenser.

30. The heat transfer device of claim 28, wherein the vapor flow restrictor comprises a perimeter and wherein the perimeter of the vapor flow restrictor is in contact with the wick such that substantially all of the vapor passes through the orifice.

31. The heat transfer device of claim 28, wherein the vapor flow restrictor is in contact with at least one portion of the interior surface.

32. The heat transfer device of claim 28, wherein the vapor flow restrictor increases vapor pressure in at least a portion of the evaporator relative to vapor pressure in the condenser.

33. The heat transfer device of claim 28, wherein the wick is disposed in both the evaporator and the condenser.

34. The heat transfer device of claim 33, wherein the working fluid flows between the evaporator and the condenser via the wick.

35. The heat transfer device of claim 28, wherein the vapor is substantially free of non-condensable gas.

36. The heat transfer device of claim 28, wherein the vapor flow restrictor is positioned no more than one-third of the way from the evaporator to the condenser.

37. The heat transfer device of claim 28, wherein the heat transfer device has a longitudinal axis and the plate is orthogonal to the axis.

38. The heat transfer device of claim 28, wherein the opening has an inlet and an outlet having cross-sectional areas of equal size.

39. The heat transfer device of claim 28, wherein the opening has a constant cross section extending through the plate.

40. A heat transfer device for conducting heat from a heat source, the heat transfer device comprising:

an evaporator for generating a vapor;

a condenser in fluid communication with the evaporator; and a vapor flow restrictor interposed between the evaporator and the condenser, wherein the vapor flow restrictor is positioned adjacent the evaporator and has opposed surfaces that are parallel to one another with an unrestricted opening of constant cross section extending between the opposed surfaces, the opening having an inlet and an outlet, the inlet and the outlet being each disposed in one of the opposed outer surfaces, respectively, and having cross-sectional areas of equal size, and wherein as the temperature of the evaporator varies, the vapor flow restrictor is configured to vary the vapor flow rate from the evaporator to the condenser through an orifice the defines a vapor flow path between the evaporator and condenser, wherein the vapor flow path is unobstructed through the orifice at all operating temperatures and thereby vary the temperature differential between the evaporator and condenser to maintain the heat source toward a constant temperature, wherein vapor passes from the evaporator toward the condenser through the vapor flow restrictor, and wherein condensed working fluid flows back toward the evaporator in an area defined between a periphery of the vapor flow restrictor and an interior wall of the heat transfer device.

41. The heat transfer device of claim 40, wherein the vapor flow restrictor increases vapor pressure in at least a portion of the evaporator relative to vapor pressure in the condenser.

42. The heat transfer device of claim 40, wherein the vapor flow restrictor is positioned at no more than half way from the evaporator to the condenser.

43. The heat transfer device of claim 40, wherein the vapor flow restrictor comprises a plate.

44. The heat transfer device of claim 40, wherein the heat transfer device has a longitudinal axis and the opposed outer surfaces are orthogonal to the longitudinal axis of the heat transfer device.

45. The heat transfer device of claim 40, wherein the vapor flow restrictor has an opening with an inlet and an outlet having cross-sectional areas of equal size.

46. The heat transfer device of claim40, wherein the opening has a constant size extending through the vapor flow restrictor.

47. A method of conducting heat from a heat source, the method comprising:

providing a heat transfer device including an evaporator for generating a vapor, and a condenser in fluid communication with the evaporator;

providing a wick on at least a portion of an interior surface of the heat transfer device;

interposing a vapor flow restrictor between the evaporator and the condenser, wherein the vapor flow restrictor is positioned adjacent the evaporator and is formed entirely of the wick; and decreasing the amount of power transmitted from the evaporator to the condenser as the temperature of the evaporator decreases to vary the temperature differential between the evaporator and condenser and thereby maintain the heat source within a predetermined operating range.

48. A heat transfer device for conducting heat from a heat source, the heat transfer device comprising:

an evaporator;

a condenser in fluid communication with the evaporator, at least one of the evaporator and condenser at least partially defining a wall of an interior space of the heat transfer device;

a wick disposed on at least a portion of an interior surface of the wall, the wick having a working fluid in contact therewith in a liquid form; and a vapor flow restrictor interposed between the evaporator and the condenser, wherein the vapor flow restrictor is positioned adjacent the evaporator, wherein the entire vapor flow restrictor has an orifice that defines a vapor flow path between the evaporator and condenser, wherein the vapor flow path is unobstructed through the orifice at all operating temperatures, wherein the vapor flow restrictor is configures to vary the vapor flow rate from the evaporator to the condenser and thereby decrease the amount of power transmitted from the evaporator to the condenser as the temperature of the evaporator decreases, wherein vapor passes from the evaporator toward the condenser through the vapor flow restrictor, and wherein condensed working fluid flows back toward the evaporator in an area between a periphery of the vapor flow restrictor and a portion of the wall.

49. The heat transfer device of claim 48, wherein the vapor flow restrictor is positioned at no more than half way from the evaporator to the condenser.

50. The heat transfer device of claim 48, wherein the vapor flow restrictor includes a plate, wherein the plate comprises a perimeter and wherein the perimeter of the plate is in contact with the wick such that substantially all of the vapor passes through the opening in the plate.

51. The heat transfer device of claim 48, wherein the vapor flow restrictor includes a plate, wherein the plate is in contact with at least one portion of the interior surface of the wall.

52. The heat transfer device of claim 48, wherein the vapor flow restrictor increases vapor pressure in at least a portion of the evaporator relative to vapor pressure in the condenser.

53. The heat transfer device of claim 48, wherein the wick is disposed in both the evaporator and the condenser.

54. The heat transfer device of claim 53, wherein the working fluid flows between the evaporator and the condenser via the wick.

55. The heat transfer device of claim 48, wherein the vapor is substantially free of non-condensable gas.

56. The heat transfer device of claim 48, wherein the vapor flow restrictor is positioned no more than one-third of the way from the evaporator to the condenser.

* * * * *